US008353191B2

(12) United States Patent
Ueoka et al.

(10) Patent No.: US 8,353,191 B2
(45) Date of Patent: Jan. 15, 2013

(54) COOLING DEVICE AND COOLING METHOD FOR HOT STRIP

(75) Inventors: Satoshi Ueoka, Fukuyama (JP); Akio Fujibayashi, Kawasaki (JP); Naoki Nakata, Fukuyama (JP); Takashi Kuroki, Fukuyama (JP); Shougo Tomita, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 1067 days.

(21) Appl. No.: 12/226,371

(22) PCT Filed: Jul. 26, 2007

(86) PCT No.: PCT/JP2007/065119

§ 371 (c)(1),
(2), (4) Date: Oct. 16, 2008

(87) PCT Pub. No.: WO2008/013318

PCT Pub. Date: Jan. 31, 2008

(65) Prior Publication Data

US 2009/0126439 A1 May 21, 2009

(30) Foreign Application Priority Data

Jul. 27, 2006 (JP) ..... 2006-204051
Aug. 21, 2006 (JP) ..... 2006-223977
Aug. 21, 2006 (JP) ..... 2006-223978
Jun. 8, 2007 (JP) ..... 2007-152367

(51) Int. Cl.
*B21B 27/06* (2006.01)

(52) U.S. Cl. ..... 72/201

(58) Field of Classification Search ..... 72/200–202, 72/342.1, 342.2, 236
See application file for complete search history.

(56) References Cited

FOREIGN PATENT DOCUMENTS

| | | | | |
|---|---|---|---|---|
| JP | 59-144513 | A | | 8/1984 |
| JP | 62-260022 | A | | 11/1987 |
| JP | 9-141322 | A | | 6/1997 |
| JP | 10-166023 | A | | 6/1998 |
| JP | 2001-286925 | A | | 10/2001 |
| JP | 2003-211205 | A | | 7/2003 |
| JP | 2007-203369 | A | | 8/2007 |
| WO | WO 9104109 | A | * | 4/1991 |

* cited by examiner

*Primary Examiner* — Debra Sullivan
(74) *Attorney, Agent, or Firm* — Holtz, Holtz, Goodman & Chick, PC

(57) ABSTRACT

A cooling device and cooling method for a hot-rolled strip in which the strip can be uniformly cooled from a leading edge to a trailing edge with coolant by properly realizing a great cooling ability and a stable cooling zone.

28 Claims, 6 Drawing Sheets

COOLING DEVICE AND COOLING METHOD FOR HOT STRIP

This application is a U.S. National Phase Application under 35 USC 371 of International Application PCT/JP2007/065119 filed Jul. 26, 2007.

TECHNICAL FIELD

The present invention relates to a cooling device and a cooling method for cooling a hot-rolled strip having a high temperature.

BACKGROUND ART

In general, a hot strip is manufactured by heating a slab to a predetermined temperature in a heating furnace, rolling the heated slab to a predetermined thickness by a roughing stand so as to form a rough bar, rolling the rough bar by a continuous finishing stand including a plurality of rolling stands so as to form a strip having a predetermined thickness. This hot strip is cooled by a cooling device provided on a run out table, and is then coiled by a down coiler.

In this case, in the cooling device provided on the run out table so as to continuously cool a hot-rolled strip having a high temperature, a plurality of laminar flows of coolant are linearly poured from a round type laminar flow nozzle onto strip-conveying roller tables over the width of the roller tables for the purpose of upper side cooling. On the other hand, spray nozzles are provided between the roller tables for the purpose of lower side cooling. From the spray nozzles, coolant is ejected. The above-described method is adopted normally.

In this known cooling device, however, coolant poured on the upper side of the strip then stays on the upper side of the strip after cooling, and this overcools the upper side. The overcool state is not uniform in the longitudinal direction of the strip, and therefore, the cooling stop temperature varies in this direction. Further, since the coolant from the round type laminar flow nozzle used for upper side cooling is poured in the form of free fall flows, it does not easily reach the strip if there is residual coolant on the upper side of the strip. Depending on whether there is residual coolant on the upper side of the strip, the cooling ability differs. Moreover, since the coolant falling on the strip freely spreads in the forward, rearward, rightward, and leftward directions, a cooling zone changes, and this causes thermal instability in cooling. As a result of this change in cooling ability, the material of the strip is apt to be uneven.

Accordingly, a method in which coolant (residual coolant) on the strip is purged for a stable cooling ability by obliquely ejecting fluid across the upper side of the strip so as to discharge the residual coolant (for example, see Patent Document 1) and a method in which a cooling zone is fixed by damming residual coolant with a restriction roller serving as a purging roller for restraining vertical motion of a strip (for example, see Patent Document 2) have been proposed. Further, as a cooling method for fixing a cooling zone by keeping coolant on a strip, a method for ejecting coolant from slit type nozzles inclined and opposing each other, as shown in FIGS. 11A and 11B (for example, see Patent Document 3) has been proposed.

Patent Document 1: Japanese Unexamined Patent Application Publication No. 9-141322

Patent Document 2: Japanese Unexamined Patent Application Publication No. 10-166023

Patent Document 3: Japanese Unexamined Patent Application Publication No. 59-144513

DISCLOSURE OF INVENTION

However, according to the method discussed in Patent Document 1, the amount of coolant staying on the strip increases toward the downstream side, and therefore, the purging effect decreases toward the downstream side.

In the method discussed in Patent Document 2, a leading edge of the strip is conveyed from the stand to the down coiler without being restrained by the restriction roller. Therefore, the purging effect of the restriction roller (purging roller) is not obtained. Moreover, since the leading edge of the strip passes over the run out table while moving up and down in a wavy manner, if coolant is supplied onto an upper surface of the leading edge of the strip, it easily and selectively stays at the bottom of the wave. Until the leading edge of the strip is coiled by the down coiler and the strip is tensioned to remove the wave, a hunting phenomenon of the cooling temperature occurs. This hunting phenomenon of the cooling temperature also causes variations in the mechanical property of the strip.

In the cooling method for keeping coolant on the strip by ejecting coolant from slit type nozzles inclined and opposing each other, as in Patent document 3, the coolant can be dammed only when the flows of coolant are continuous slit type flows. In order to keep continuous slit type flows, it is impossible to place the nozzles and the strip apart from each other. Moreover, in this method, a partition plate is provided near the leading ends of the nozzles so as to fill the coolant. Therefore, the strip, the nozzles, and the partition plate must be placed close to one another, and there is a high possibility that the strip will collide with the nozzles and the partition plate. In particular, when the strip has an undesirable wavy shape, it inevitably touches the nozzles and the partition plate, and is thereby scratched. Therefore, it is difficult to apply the method to actual operation.

In this way, according to the methods discussed in Patent Documents 1 to 3, it is impossible to properly obtain a great cooling ability and a stable cooling ability.

During manufacturing of a hot strip, the temperature of a surface of a region of the run out table near the down coiler sometimes becomes, for example, 550° C. or less, and this causes the following problem.

That is, in this region, cooling shifts from a heat transfer state in which film boiling is dominant and a steam film exists between the strip and the coolant to a region where so-called nucleate boiling caused by a direct contact between the strip and the coolant is dominant. This boiling phenomenon in which transition of the boiling state is made is called transition boiling, and cooling is promoted rapidly. As a result of such promotion of cooling, only a surface layer of the strip is rapidly cooled, and an undesirable structure is sometimes formed. For example, when the temperature of a portion close to the surface layer falls to 400° C. or less, martensite is formed as a structure. Even if the temperature of the surface layer is then recovered and coiling is finished at 500° C., a structure different from that of the inside, such as tempered martensite, is sometimes formed in the surface layer.

Further, since the coolant adheres to the strip from the transition boiling region to the nucleate boiling region, it remains in an air cooling zone out of the cooling device (zone), and a so-called purging failure state is easily brought about. This portion is overcooled, and the quality of the strip is uneven.

Hitherto, the cooling speed has been increased from the viewpoint of the material by simply increasing the amount of coolant from the round type laminar flow nozzles. However, if a large quantity of coolant is vertically ejected onto the strip, it cannot be dammed by the methods disclosed in Patent Documents 1 and 2, and a large quantity of residual coolant is provided on the strip. As a result, serious temperature unevenness occurs.

The present invention has been made in view of the above-described circumstances, and an object of the invention is to provide a cooling device and a cooling method for a hot-rolled strip in which the strip can be uniformly cooled from a leading edge to a trailing edge with coolant by properly realizing a great cooling ability and a stable cooling zone.

In order to solve the above-described problems, the present invention has the following features:

In accordance with a first aspect of the invention, a hot-strip cooling device is provided for cooling a hot strip conveyed on a run out table after finish rolling, wherein cooling nozzles inclined toward a downstream side and an upstream side in a traveling direction of the strip are arranged on an upper side of the strip so as to oppose each other, and the cooling nozzles eject rodlike flows of coolant.

In accordance with a second aspect of the invention, a plurality of the cooling nozzles are arranged in a width direction of the strip, and an angle formed by the rodlike flows ejected from the cooling nozzles and the strip is 60° or less.

In accordance with a third aspect of the invention, a plurality of rows of the cooling nozzles inclined to the downstream side and a plurality of rows of the cooling nozzles inclined to the upstream side are arranged in the traveling direction of the strip.

In accordance with a fourth aspect of the invention, the hot-strip cooling device is formed by one cooling device unit, and a plurality of the cooling device units are arranged in the traveling direction of the strip.

In accordance with a fifth aspect of the invention, purging means for purging coolant on an upper surface of the strip are provided downstream from the cooling device unit.

In accordance with a sixth aspect of the invention, a hot-strip cooling device is provided for cooling a hot strip conveyed on a run out table after finish rolling, wherein a cooling nozzle for ejecting an inclined rodlike flow of coolant from an upstream side of a roller table toward just above the roller table and a cooling nozzle for ejecting an inclined rodlike flow of coolant from a downstream side of a roller table toward just above the roller table are arranged on an upper side of the strip so as to oppose each other.

In accordance with a seventh aspect of the invention, the cooling nozzles on the upper side and a cooling nozzle on a lower side of the strip are arranged so that a cooling amount by coolant on the upper side of the strip is equal to a cooling amount by coolant on the lower side of the strip.

In accordance with an eighth aspect of the invention, a cooling nozzle for ejecting a rodlike flow of coolant from between roller tables toward a lower surface of the strip is provided on the lower side of the strip.

In accordance with a ninth aspect of the invention, a lower side cooling nozzle for ejecting coolant from between roller tables toward a lower surface of the strip is provided on a lower side of the strip, and a cooling nozzle for ejecting an inclined rodlike flow of coolant from an upstream side of a position where the coolant ejected from the lower side cooling nozzle collides with the strip toward just above the position and a cooling nozzle for ejecting an inclined rodlike flow of coolant from a downstream side of the position where the coolant ejected from the lower side cooling nozzle collides with the strip toward just above the position are arranged on the upper side of the strip so as to oppose each other.

In accordance with a tenth aspect of the invention, the upper side cooling nozzles and the lower side cooling nozzle are arranged so that a cooling amount by the coolant on the upper side of the strip is equal to a cooling amount by the coolant on the lower side of the strip and so that a fluid pressure received by the strip from the coolant on the upper side of the strip is equal to a fluid pressure received by the strip from the coolant on the lower side of the strip.

In accordance with an eleventh aspect of the invention, the lower side cooling nozzle is a nozzle for ejecting a rodlike flow of coolant.

In accordance with a twelfth aspect of the invention, a hot-strip cooling method is provided for cooling a hot strip conveyed on a run out table after finish rolling, wherein a rodlike flow of coolant inclined to a downstream side in a traveling direction of the strip and a rodlike flow of coolant inclined to an upstream side in the traveling direction of the strip are ejected on an upper side of the strip so as to oppose each other.

In accordance with a thirteenth aspect of the invention, an angle formed by the rodlike flows of coolant and the strip is 60° or less.

In accordance with a fourteenth aspect of the invention, a plurality of rows of the rodlike flows of coolant inclined to the downstream side and a plurality of rows of the rodlike flows of coolant inclined to the upstream side are ejected in the traveling direction of the strip.

In accordance with a fifteenth aspect of the invention, intermittent cooling for repeating water cooling and air cooling is performed by performing opposing ejection of the inclined rodlike flows of coolant at a plurality of positions spaced in the traveling direction of the strip.

In accordance with a sixteenth aspect of the invention, the coolant is purged by purging means provided downstream from the positions where opposing ejection of the inclined rodlike flows of coolant is performed.

In accordance with a seventeenth aspect of the invention, a rodlike flow of coolant inclined from an upstream side of a roller table toward just above the roller table and a rodlike flow of coolant inclined from a downstream side of a roller table toward just above the roller table are ejected on the upper side of the strip so as to oppose each other.

In accordance with an eighteenth aspect of the invention, the coolant is ejected onto the upper side and the lower side of the strip so that a cooling amount by the coolant on the upper side of the strip is equal to a cooling amount by the coolant on the lower side of the strip.

In accordance with a nineteenth aspect of the invention, a rodlike flow of coolant is ejected from between roller tables toward a lower surface of the strip on the lower side of the strip.

In accordance with a twentieth aspect of the invention, coolant is ejected from between roller tables toward a lower surface of the strip on the lower side of the strip, and an inclined rodlike flow of coolant ejected from an upstream side of a position where the coolant on the lower side collides with the strip toward just above the position and an inclined rodlike flow of coolant ejected from a downstream side of the position where the coolant on the lower side collides with the strip toward just above the position oppose each other on the upper side of the strip.

In accordance with a twenty-first aspect of the invention, the coolant is ejected on the upper side and the lower side of the strip so that a cooling amount by the coolant on the upper side of the strip is equal to a cooling amount by the coolant on the lower side of the strip and so that a fluid pressure received by the strip from the coolant on the upper side of the strip is equal to a fluid pressure received by the strip from the coolant on the lower side of the strip.

In accordance with a twenty-second aspect of the invention, the coolant on the lower side of the strip includes a rodlike flow of coolant.

REFERENCE NUMERALS IN THE DRAWINGS DENOTE THE FOLLOWING COMPONENTS

1: roughing stand, 2: rough bar, 3: roller table, 4: continuous finishing stand, 4E: final finishing stand, 5: run out table, 6: down coiler, 7: known type of cooling device, 8: round type laminar flow nozzle, 9: roller table, 10: spray nozzle, 11: cooling device according to the present invention, 12: strip, 13: cooling nozzle header, 14: round nozzle, 15: supply tube, 16: ejection valve, 17: cooling unit, 18: cooling nozzle header, 19: round nozzle, 20: supply tube, 21: ejection valve, 22: air jet nozzle

BEST MODES FOR CARRYING OUT THE INVENTION

Embodiments of the present invention will be described below with reference to the drawings.

Figure 1:
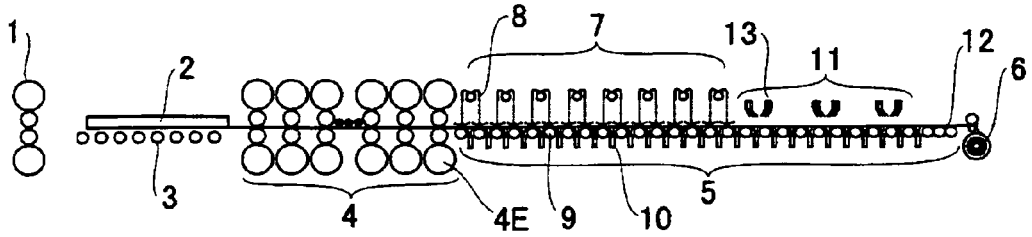
FIG. 1 is a schematic structural view of rolling equipment according to a first embodiment of the present invention.

FIG. 1 shows manufacturing equipment for a hot strip according to an embodiment of the present invention. A rough bar 2 rolled by a roughing stand 1 is conveyed on roller tables 3, is continuously rolled into a strip 12 having a predetermined thickness by seven continuous finishing stands 4, and is then guided to a run out table 5 provided behind a final finishing stand 4E so as to form a strip conveying path. The run out table 5 has an overall length of about 100 m, and is partly or substantially entirely provided with a cooling device. After being cooled in the cooling device, the strip 12 is coiled by a down coiler 6 so as to be a hot-rolled coil.

In this embodiment, a known type of cooling device 7 and a cooling device 11 according to the present invention are arranged in that order as examples of cooling devices provided on the run out table 5 for upper side cooling.

The known type of cooling device 7 includes a plurality of round type laminar flow nozzles 8 that are arranged at a predetermined pitch on the upper side of the run out table 5 so as to supply coolant in the form of free fall flows onto the strip.

As a cooling device for lower side cooling, a plurality of spray nozzles 10 are provided between strip-conveying roller tables 9 and are arranged in line in the width direction. The ejection pressure and coolant density of the spray nozzles 10 are adjustable.

An example of the cooling device 11 according to the present invention will be described with reference to FIG. 2 serving as an enlarged partial view. On the run out table 5, for example, roller tables 9 that rotate for strip conveyance are arranged at a pitch of about 400 mm in the longitudinal direction. The roller tables 9 have a diameter of 330 mm. A strip 12 travels over the roller tables 9.

In the cooling device 11 of the present invention, a plurality of upper side cooling units 17 are arranged at regular intervals on the upper side of the strip 12. Each upper side cooling unit 17 ejects rodlike flows of coolant inclined to the downstream and upstream sides in the traveling direction of the strip 12 and opposing each other.

A lower side cooling device in this region is not particularly limited, and, for example, spray cooling may be performed, or rodlike flows adopted for upper side cooling in the present invention may be adopted.

In this embodiment, spray nozzles 10 similar to those provided in the region of the above-described known cooling device 7 are used.

Each upper side cooling unit 17 is divided into an upstream section and a downstream section in the strip traveling direction, and each section includes a predetermined number of rows (four rows in this embodiment) of cooling nozzle headers 13. Supply tubes 15 are connected to the corresponding cooling nozzle headers 13, and on/off control of the supply tubes 15 can be independently performed by valves 16. In each cooling nozzle header 13, round nozzles 14 are arranged in line at a predetermined pitch in the width direction. The round nozzles 14 have a predetermined ejection angle θ (for example, 50°) with respect to the strip traveling direction.

These round nozzles 14 are straight nozzles each having an inner diameter of 3 to 10 mm and a smooth inner surface. Rodlike flows of coolant are ejected from the round nozzles 14. The rodlike flows of coolant form the predetermined angle θ with the strip 12 in a predetermined direction, that is, in the traveling direction of the strip 12. While the round nozzles 14 may be parallel to the strip 12 in the width direction of the strip 12, it is preferable that the round nozzles 14 be inclined outward from the widthwise center of the strip 12 at 1° to 30°, more preferably, 5° to 15° so that ejected coolant quickly flows down from both edges of the strip 12. The exits of the round nozzles 14 are provided at a predetermined height (for example, 1000 mm) from the upper side of the strip 12 so that the strip 12 will not touch the round nozzles 14 even when the strip 12 moves up and down.

A rodlike flow in the present invention refers to a flow of coolant that is ejected from a round (including an elliptical or polygonal shape) type nozzle port under some pressure, that is ejected from the nozzle port at an ejection speed of 7 m/s or more, that keeps a substantially circular cross section until while it is ejected from the nozzle port and collides with the strip, and that has continuity and linearity. In other words, a rodlike flow is different from a free fall flow from a round type laminar flow nozzle and droplets ejected like a spray.

It is preferable to shift the rows of round nozzles 14 from one another in the width direction so that rodlike flows of coolant in a row collide with almost the midpoints between positions where rodlike flows in the preceding row collide. Consequently, rodlike flows of coolant in a row collide with portions, where cooling is weakened, between rodlike flows of coolant adjacent in the with direction in the preceding row. This complements cooling and allows uniform cooling in the width direction.

From four rows of round nozzles 14 on the upstream side and four rows of round nozzles 14 on the downstream side in the strip traveling direction, flows of coolant are ejected toward almost the same position on the strip 12 (for example, toward the same roller table 9) so as to oppose each other.

In this way, when rodlike flows of coolant are ejected from the round nozzles 14 arranged in a line, they flow in parallel and flow intermittently in the shape of a false plane. Further, since rodlike flows ejected from four rows of round nozzles 14 on the upstream side and rodlike flows ejected from four rows of round nozzles 14 on the downstream side in the strip traveling direction oppose each other, the flows of coolant colliding with the strip 12 are dammed by each other, and fall outward from both edges of the strip 12 at the colliding positions. This prevents the flows of coolant from flowing to the upstream and downstream sides on the strip.

In this case, when the ejection angle θ exceeds 60°, the coolant may flow to the upstream and downstream sides on the strip, depending on the speed of the strip 12. Therefore, it is preferable to set the ejection angle θ at 60° or less. When the ejection angle θ is 60° or less, the coolant will not flow to the upstream and downstream sides on the strip, regardless of the speed of the strip 12. It is more preferable to set the ejection angle θ at 50° or less. However, in a case in which the ejection angle θ is smaller than 45°, if the height of the round nozzles 14 from the strip 12 is set at a desired value (for example, 1000 mm) in order to avoid a collision between the strip 12 and the round nozzles 14, the distance for which rodlike flows of coolant ejected from the round nozzles 14 flow until colliding with the strip 12 is too long. In this case, the rodlike flows may be dispersed and this may deteriorate the cooling characteristic. Therefore, it is preferable to set the ejection angle θ at 45° to 60°, and more preferable to set the ejection angle θ at about 45° to 50°.

Incidentally, the cooling device 11 of the present invention adopts the round nozzles 14, which form rodlike flows of coolant, as the nozzles for cooling the upper side of the strip 12 for the following reason.

That is, in order to reliably perform cooling, it is necessary for the coolant to reliably reach and collide with the strip 12. For that purpose, fresh coolant must reach the strip 12 by penetrating residual coolant on the upper side of the strip 12, and the coolant needs to be ejected not in the form of droplets having a weak penetrating force like droplets sprayed from a spray nozzle, but in the form of rodlike flows of coolant that has continuity, linearity, and a strong penetrating force. Further, since laminar flows from conventional round type laminar flow nozzles are free fall flows, if there is residual coolant, the laminar flows do not easily reach the strip 12, and the cooling ability varies depending on whether residual coolant exists. When the speed of the strip changes, the cooling ability changes since the flows falling on the strip 12 spread around.

Therefore, in the present invention, the round nozzles 14 (they may be elliptical or polygonal) are used, the ejection speed of coolant from the nozzle ports is 7 m/s or more, and rodlike flows of coolant having continuity and linearity are ejected from the nozzle ports. The cross section of the flows is kept substantially circular until the flows from the nozzle ports collide with the strip. When the rodlike flows of coolant are ejected from the nozzle ports at an ejection speed of 7 m/s or more, they can stably penetrate the residual coolant on the upper side of the strip even when being ejected obliquely.

It is conceivable to use curtain-shaped continuous laminar flows, instead of rodlike flows of coolant. However, if slit type nozzles have a gap that does not clog the nozzles (a gap of 3 mm or more is necessary in practice), the cross sectional area of the nozzles is considerably larger than when the round nozzles 14 are arranged at intervals in the width direction. For this reason, when coolant is ejected from the nozzle ports at an ejection speed of 7 m/s or more in order to provide a force of penetrating the residual coolant, a large amount of coolant is necessary. This makes the equipment cost extremely high, and it is difficult to realize the ejection. Further, since the first row of curtain-shaped laminar flows of coolant colliding with the strip 12 form a layer that hinders collisions of the second and subsequent rows of flows, the cooling ability declines in the second and subsequent rows or the cooling ability varies in the width direction. In contrast, rodlike flows of coolant push portions of the layer of residual coolant aside and reach the strip 12. Since the pushed coolant flows while slipping between the intermittent rodlike flows, the coolant remaining after cooling rarely hinders subsequent cooling processes.

Since a plurality of cooling units 17 are arranged at regular intervals in the cooling device 11 of the present invention, air cooling zones are provided between the cooling units 17, that is, so-called intermittent cooling is performed. Therefore, particularly when a hard layer, such as martensite, is easily formed in a strip by overcooling the surface thereof, even if the temperature of the surface layer decreases, it is increased by internal heat in the next air cooling zone. Therefore, overcooling of the surface layer is suppressed, and not only temperature variations, but also variations of the micro structure in the thickness direction of the strip are reduced. In this embodiment, since the cooling ability of the cooling device 11 of the present invention provided on the upper side is higher than that of the known spray nozzles 10, it is preferable to set the distance between the upper side cooling units or to increase the pressure and flow rate of coolant for lower side cooling so that upper side cooling and lower side cooling are performed in a well-balanced manner.

In the cooling device 11 of the present invention, an air jet nozzle 22 provided downstream from each cooling unit 17 performs purging so that the coolant does not flow out. In general, purging is performed by a purging method of jetting water. However, when the surface temperature of the strip is 550° C. or less, if purging is performed with water, there is a possibility that the coolant will adhere to the surface of the strip, that purging will be imperfect, and that local overcooling will occur. Therefore, in this case, it is preferable to perform purging by jetting air. While it is preferable that the air jet nozzle 22 be provided on the downstream side of every cooling unit 17, it is satisfactory as long as the air jet nozzle 22 is provided downstream from the most downstream cooling unit 17.

When the cooling device 11 having the above-described configuration is used, cooling is controlled as follows.

First, the length of the cooling zone on the upper side where ejection is performed is found from the speed of the strip, measured temperature, and the amount of cooling to the cooling stop temperature for the target thickness. Then, the number of cooling unit 17 that cover the found cooling zone length, and the number of rows of cooling nozzle headers 13 that perform ejection in the cooling units 17 are determined, and the corresponding ejection valves 16 are opened. Subsequently, the number of cooling units 17 and the number of rows of cooling nozzle headers 13 that perform ejection are adjusted so as to change the cooling zone length while checking the record of a thermometer after cooling and considering the change of the strip speed (acceleration, deceleration). When changing the number of rows of cooling nozzle headers 13, in order to minimize outflow of the coolant into non-cooling zones (air cooling zones) on the strip, it is preferable to adjust the number of rows for ejection from the upstream side to the downstream side and the rows for ejection from the downstream side to the upstream side so that the fluid pressure of the coolant is balanced between the upstream and downstream sides of the strip. For example, it is preferable that the upstream and downstream cooling nozzle headers be turned on and off in pairs.

The above-described embodiment can obtain the following advantages:

(1) The strip can be uniformly cooled from the leading edge to the trailing edge, and the quality of the strip is stabilized. This reduces the cutting allowance of the strip, and increases the yield.

(2) Since intermittent cooling is performed, particularly when the strip is cooled to a low temperature range of 500° C. or less, a structure abnormality (for example, formation of martensite) does not occur in the surface layer of the strip, and a desired structure can be obtained over the entire cross section of the strip (from the surface layer to the center in the thickness direction).

Figure 2:
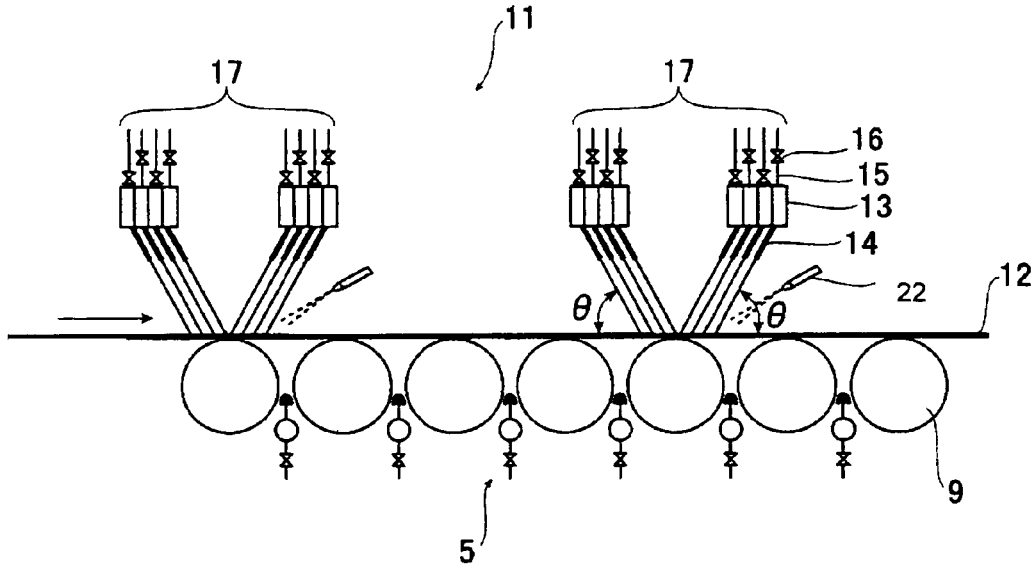
FIG. 2 is an explanatory view of a cooling device in the first embodiment of the present invention.

In FIG. 2 showing the first embodiment, the opposing ejection positions (colliding positions) for upper side cooling are provided on the roller tables. This is because the ejection positions are preferable in terms of threading stability.

Figure 3:
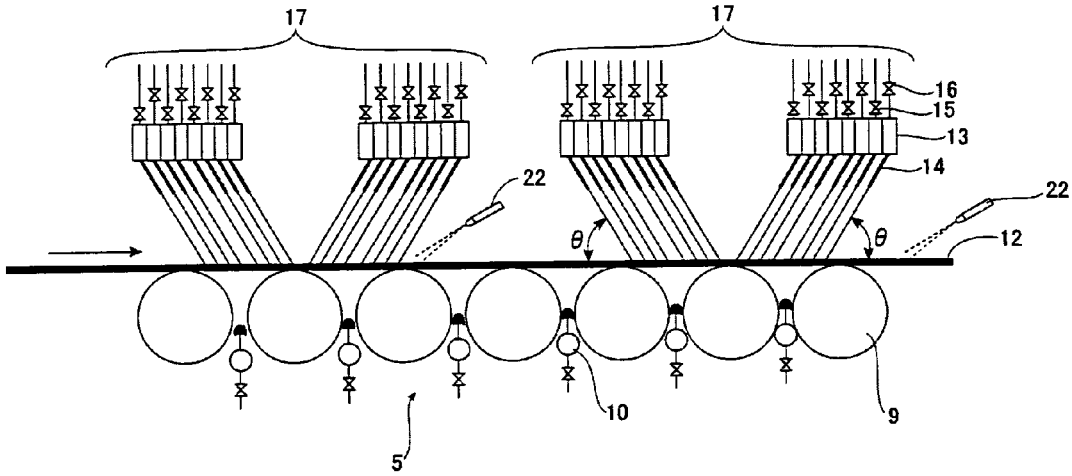
FIG. 3 is an explanatory view of a cooling device in the first embodiment of the present invention.

Alternatively, for example, the opposing ejection positions (colliding positions) for upper side cooling may be provided between the roller tables, as shown in FIG. 3. In this case, if the strip is pressed by rodlike flows of coolant from the upper side cooling device, it may be bent between the roller tables, and threading may become unstable. In order to prevent this, it is preferable to eject a larger amount of coolant at a higher pressure than in the known type of cooling device so that a push-up force in lower side cooling is substantially equal to the pressing force in upper side cooling.

Figure 4:
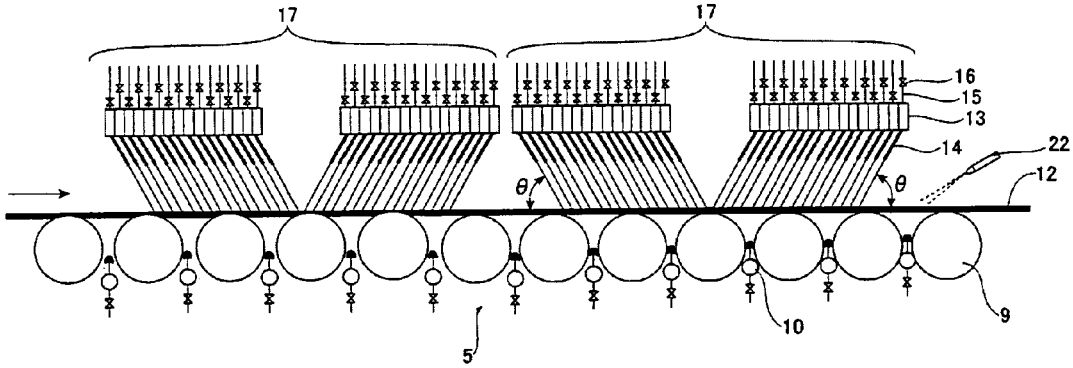
FIG. 4 is an explanatory view of a cooling device in the first embodiment of the present invention.

Each upper side cooling unit 17 is divided into the upstream section and the downstream section in the strip traveling direction, and each section includes four rows of cooling nozzle headers 13 in FIG. 2, and eight rows of cooling nozzle headers 13 in FIG. 3. The number of rows is not limited, and an appropriate number of rows can be placed. However, when the number of rows increases, the length of the range where rodlike flows of coolant collide with the strip increases in the strip traveling direction. Therefore, the rodlike flows of coolant cannot always collide with the strip only just above the roller tables. In this case, rodlike flows of coolant are caused to collide with the strip just above the roller tables and between the roller tables. That is, for example, when sixteen rows of nozzle headers are provided on each of the upstream and downstream sides in the strip traveling direction, as shown in FIG. 4, the range where rodlike flows of coolant collide with the strip is sometimes longer than the mounting pitch of the roller tables. In this case, the range may extend just above the roller tables and between the roller tables.

While the known type of cooling device 7 and the cooling device 11 of the present invention are arranged in that order as the cooling devices provided on the run out table 5 for upper side cooling in this embodiment, it is satisfactory as long as the cooling device 11 of the present invention forms a part or the entirety of the cooling device provided on the run out table 5. Although cooling is brought into an unstable state called transition boiling in the region near the down coiler, depending on the coiling temperature, as described above, the cooling device 11 of the present invention allows nucleic boiling over the entire region, and avoids the transition boiling region where cooling is unstable. Since stable cooling can be performed, regardless of the coiling temperature and the coiling temperature can be controlled precisely, it is preferable that the cooling device 11 of the present invention be provided at least just before the down coiler. With this arrangement, unstable cooling is avoided and temperature variations are small even at a low coiling temperature (500° C. or less). As a result, the quality of the strip, such as strength and elongation, is uniform over the overall length of the strip.

Figure 5:
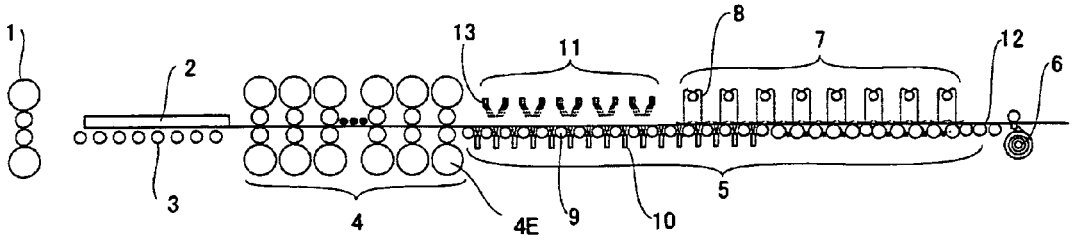
FIG. 5 is an explanatory view of a cooling device according to a second embodiment of the present invention.

FIG. 5 shows hot-strip manufacturing equipment according to a second embodiment of the present invention.

While a manufacturing process from rough rolling to coiling is the same as that adopted in the first embodiment, a cooling device 11 of the present invention is provided upstream from a known-type of cooling device 7 in the second embodiment. In the cooling device 11 of the present invention, three upper side cooling units, each having sixteen rows of cooling nozzle headers provided on each of the upstream and downstream sides, as shown in FIG. 4, are arranged in the strip traveling direction. Similarly to the first embodiment, roller tables 9 that rotate to convey a strip are arranged on a run out table 5, for example, at a pitch of about 400 mm in the longitudinal direction. The roller tables 9 have a diameter of 330 mm. A strip 12 travels over the roller tables 9. A cooling device provided on the lower side in this region is not particularly limited, and spray nozzles 10 similar to those in the region of the above-described known-type cooling device 7 are used herein. However, since rodlike flows of coolant collide between the roller tables in the cooling device 11 of the present invention, the strip is easily bent by being pressed from above during threading. In order to correct the bend, the amount and pressure of coolant from the spray nozzles 10 adopted in the lower side cooling device are increased so as to balance the force on the upper side and the force on the lower side.

As shown in FIG. 4, supply tubes 15 are connected to the corresponding cooling nozzle headers 13, and on/off control of the supply tubes 15 can be independently performed by valves 16. In each cooling nozzle header 13, round nozzles 14 are arranged in a line at a predetermined pitch in the width direction. The round nozzles 14 have a predetermined ejection angle θ (for example, 45°) with respect to the strip traveling direction.

Similarly to the first embodiment, the round nozzles 14 are straight nozzles each having an inner diameter of 3 to 10 mm and a smooth inner surface. Rodlike flows of coolant are ejected from the round nozzles 14. The rodlike flows of coolant form a predetermined angle θ with the strip 12 in a predetermined direction, that is, in the traveling direction of the strip 12. The mounting pitch of the rodlike flows in the width direction of the strip 12 and the structure of the rodlike flows can basically be the same as in the first embodiment.

In order to prevent the coolant from flowing out, the same purging method as that adopted in the first embodiment can be performed on the downstream side of the cooling unit 17.

The order in which coolant is poured in the cooling nozzle headers can be determined, as in the description of the first embodiment.

This embodiment can basically obtain the same advantages as (1) and (2) of the first embodiment, and also can obtain an advantage (3):

(1) The strip can be uniformly cooled from the leading edge to the trailing edge, and the quality of the strip is stabilized. This reduces the cutting allowance of the strip, and increases the yield.

(2) Since intermittent cooling is performed, particularly when the strip is cooled to a low temperature range, a structure abnormality (for example, formation of martensite) does not occur in the surface layer of the strip, and a desired structure can be obtained over the entire cross section of the strip (from the surface layer to the center in the thickness direction).

(3) By increasing the number of rows of nozzles in each cooling unit and shortening air cooling zones between the cooling units, a relatively high cooling speed can be obtained, and the cooling speed rarely varies in the thickness direction. Therefore, a hard layer, such as bainite, can be formed in the entire strip. This allows manufacturing of a material having high strength.

As the cooling devices provided on the run out table 5 for upper side cooling, the cooling device 11 of the present invention is provided downstream from the known type of cooling device 7 in the first embodiment, and the cooling device 11 of the present invention is provided upstream from the known type of cooling device 7 in the second embodiment. The arrangement is not limited to the above.

Figure 6:
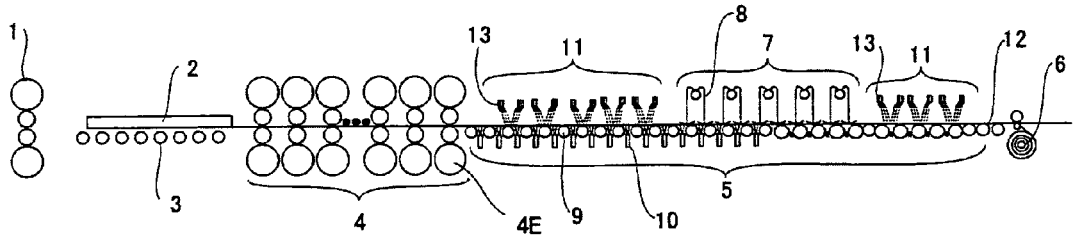
FIG. 6 is an explanatory view of a cooling device according to a third embodiment of the present invention.

For example, as a third embodiment, a known type of cooling device 7 may be provided downstream from a cooling device 11 of the present invention, and another cooling device 11 of the present invention may be provided downstream from the known type of cooling device 7, as shown in FIG. 6. In this case, the upstream cooling device 11 of the present invention (cooling device close to a finish stand 4) may include cooling nozzle headers shown in FIG. 4 and the downstream cooling device 11 of the present invention (cooling device close to a down coiler 6) may include cooling nozzle headers shown in FIG. 2. The above structure may be reversed.

As another embodiment, only a cooling device 11 of the present invention may be provided. In this case, cooling nozzle headers shown in FIGS. 2 to 4 may be mixed.

In other words, it is satisfactory as long as the cooling device 11 of the present invention forms a part or the entirety of the cooling device provided on the run out table 5.

Incidentally, as described above, cooling is sometimes brought into an unstable state, called transition boiling, near the down coiler, depending on the coiling temperature. According to the cooling device 11 of the present invention, nucleic boiling occurs over the entire strip, and this avoids the transition boiling region where cooling is unstable. When it is necessary to set the coiling temperature at a low temperature (for example, 500° C. or less), the cooling device 11 of the present invention is provided near the down coiler. Further, when a high-strength material is manufactured by forming a hard layer, such as bainite or martensite) over the entire thickness, it is preferable to perform rapid cooling after finish rolling. Therefore, it is preferable to place the cooling units so as to minimize the length of the air cooling zone, and near the finishing stand. Of course, when low-temperature coiling is performed and a high-strength material is manufactured, the cooling devices 11 of the present invention can be respectively provided at the upstream and downstream sides of the run out table, as in the third embodiment shown in FIG. 6.

While the opposing ejection positions for upper side cooling (positions where rodlike flows of coolant collide with the strip) and the lower side cooling method adopted in the above-described embodiments are not limited, they may be determined as in the following embodiment.

A cooling device according to a further embodiment of the present invention will be described with reference to FIG. 7 serving as an enlarged partial view. On a run out table 5, roller tables 9 that rotate for strip conveyance are arranged, for example, at a pitch of about 400 mm in the longitudinal direction. The roller tables 9 have a diameter of 330 mm. A strip 12 travels over the roller tables 9. In the cooling device 11 of this embodiment, a plurality of upper side cooling units 17 are arranged in the strip traveling direction on the upper side of the strip 12. Each upper side cooling unit 17 ejects rodlike flows of coolant inclined and opposing each other from the upstream and downstream sides of the same roller table 9 toward just above the roller table. The upper side cooling unit 17 is similar to those in the first to third embodiments except that round nozzles 14 for ejecting rodlike flows of coolant are arranged so as to oppose each other just above the same roller table 9.

On the other hand, in the cooling device 11 of this embodiment, cooling nozzles on the lower side of the strip are not particularly limited. However, in this embodiment, it is preferable to use round nozzles that can be easily mounted in narrow spaces, for example, between roller tables and that eject rodlike flows of coolant having a great ability to penetrate a film of coolant when a large amount of coolant is ejected. In other words, in this embodiment, cooling nozzle headers 18 are provided between adjacent roller tables, and each cooling nozzle header 18 includes a predetermined number of (two in this embodiment) rows of round nozzles 19 arranged at a predetermined pitch in the width direction so as to eject rodlike flows of coolant. Supply tubes 20 are connected to the corresponding cooling nozzle headers 18, and on/off control of the supply tubes 20 can be independently performed by ejection valves 21. By thus using the round nozzles that eject rodlike flows of coolant having high cooling performance as the cooling nozzles for lower side cooling, it is possible to shorten the length of the cooling zone and to make the device compact.

In this case, it is preferable to adjust the arrangement of the cooling nozzles on the upper and lower sides of the strip 12 and the density and arrival speed of coolant so that the cooling amount by the coolant on the upper side of the strip (rodlike flows of coolant from the round nozzles 14) is equal to the cooling amount by the coolant on the lower side of the strip (rodlike flows of coolant from the round nozzles 19).

In the cooling device 11 of this embodiment, inclined rodlike flows of coolant are ejected from the upper side cooling unit 17 toward just above the same roller table 9 so as to oppose each other. Therefore, the strip 12 travels over the run out table 5 while being pressed against the roller tables 9 by the rodlike flows, and threading of the strip 12 is stabilized even in a no-tension state until the leading edge of the strip 12 is coiled by a down coiler 6.

In the cooling device 11 of this embodiment, purging is also performed by an air jet nozzle 22 provided downstream from each cooling unit 17 so that coolant on the upper side of the strip does not flow out.

When the cooling device 11 having the above-described configuration is used, cooling is controlled as follows. First, the lengths of cooling zones on the upper and lower sides where ejection is performed are found from the speed of the strip, measured temperature, and the amount of cooling to the cooling stop temperature for the target thickness. Then, the number of cooling units 17 that cover the found cooling zone length on the upper side, and the number of rows of cooling nozzle headers 13 that perform ejection in the cooling units 17 are determined, and the corresponding ejection valves 16 are opened. Further, the number of cooling nozzle headers 18 that cover the found cooling zone length on the lower side is determined, and the corresponding ejection valves 21 are opened. In this case, it is preferable that the cooling amount by coolant on the upper side of the strip be equal to the cooling amount by coolant on the lower side of the strip.

Subsequently, the number of cooling units 17 and the number of rows of cooling nozzle headers 13 that perform ejection on the upper side, and the number of cooling nozzle headers 18 that perform ejection on the lower side are adjusted so as to change the cooling zone lengths while checking the record of the thermometer after cooling and considering the change of the strip speed (acceleration, deceleration). When changing the number of rows of cooling nozzle headers 13, in order to minimize outflow of the coolant into non-cooling zones (air cooling zones) on the strip, it is preferable to adjust the number of rows for ejection from the upstream side to the downstream side and the number of rows for ejection from the downstream side to the upstream side so that the fluid pressure of coolant is balanced between the upstream and downstream sides of the strip. For example, it is preferable that upstream and downstream cooling nozzle headers be turned on and off in pairs.

The above-described embodiment can obtain the following advantages.

(1) The strip can be uniformly cooled from the leading edge to the trailing edge, and the quality of the strip is stabilized. This reduces the cutting allowance of the strip and increases the yield.

(2) Since the strip travels over the run out table while being pressed against the roller tables by rodlike flows, threading of the strip is stable even in a no-tension state until the leading edge of the strip is coiled. Consequently, trouble, such as a strip jam and a shutdown, is reduced.

Figure 7:
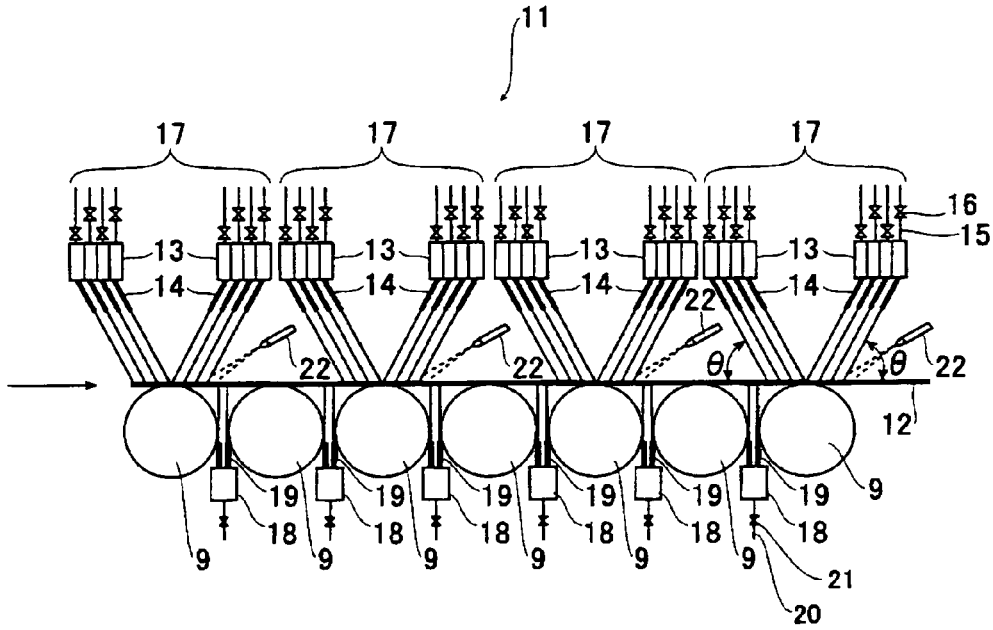
FIG. 7 is an explanatory view of a cooling device according to another embodiment of the present invention.
Figure 8:
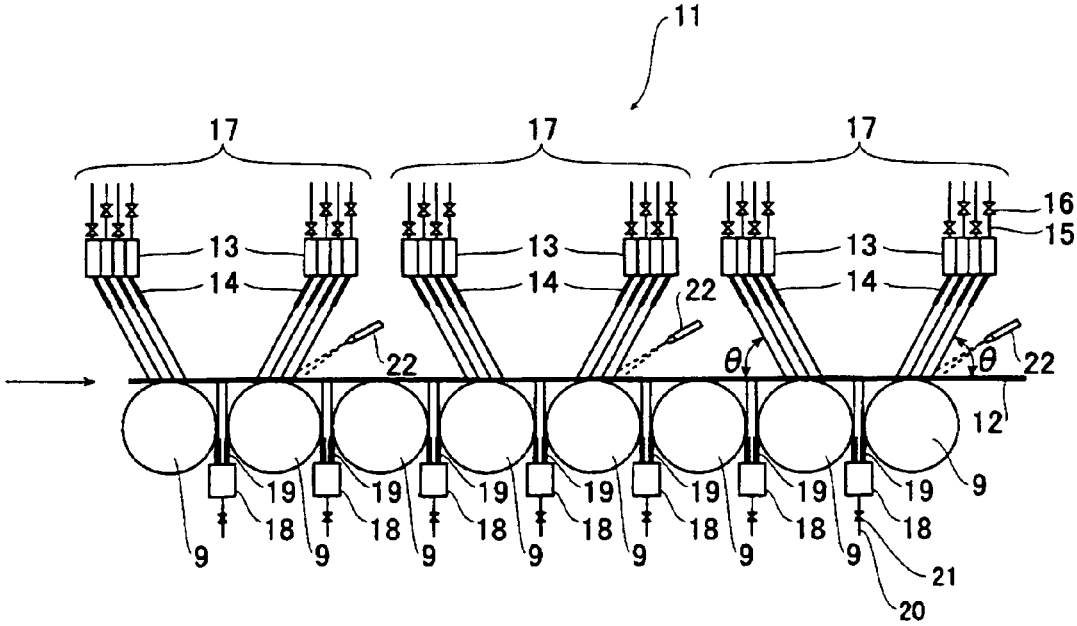
FIG. 8 is an explanatory view of a cooling device in the further embodiment of the present invention.

While inclined rodlike flows of coolant are ejected from the upstream and downstream sides of the same roller table toward just above the roller table on the upper side of the strip so as to oppose each other in this embodiment, as shown in FIG. 7, the present invention is not limited thereto. For example, as shown in FIG. 8, inclined rodlike flows of coolant ejected from the upstream side of a roller table toward just above the roller table and inclined rodlike flows of coolant ejected from the downstream side of a roller table provided downstream from the above roller table toward just above the roller table may oppose each other. However, in order for the coolant ejected onto the upper side of the strip to quickly flow down from both edges of the strip and to stabilize threading, it is preferable to eject opposing rodlike flows toward just above the same roller table.

A cooling device 11 according to a further embodiment of the present invention will be described with reference to FIG. 9 serving as an enlarged partial view. On a run out table 5, roller tables 9 that rotate for strip conveyance are arranged, for example, at a pitch of about 400 mm in the longitudinal direction. The roller tables 9 have a diameter of 330 mm. A strip 12 travels over the roller tables 9. In the cooling device 11 of this embodiment, a plurality of cooling units 17 are arranged in the strip traveling direction. In each cooling unit 17, lower side cooling nozzles 19 are provided on the lower side of the strip 12 so as to eject rodlike flows of coolant from between the roller tables 9 toward the lower side of the strip, and cooling nozzles 14 oppose each other on the upper side of the strip 12. Toward just above the positions where the rodlike flows ejected from the lower cooling nozzles 19 collide with the strip 12, the cooling nozzles 14 eject inclined rodlike flows of coolant from the upstream and downstream sides of the positions. The upper side cooling units in the cooling units 17 are similar to those in the first to third embodiments except that round nozzles 14 for ejecting rodlike flows of coolant oppose each other so as to point toward just above the positions where rodlike flows ejected from the lower side cooling nozzles 19 collide with the strip 12.

On the other hand, cooling nozzle headers 18 are provided between the roller tables 9 in each cooling unit 17 on the lower side of the strip. In each cooling nozzle header 18, a predetermined number of rows (three rows herein) of round nozzles 19 for ejecting rodlike flows of coolant are arranged at a predetermined pitch in the width direction. Supply tubes 20 are connected to the corresponding cooling nozzle headers 18, and on/off control of the supply tubes 20 can be independently performed by ejection valves 21. By thus using the round nozzles that eject rodlike flows of coolant having high cooling performance as the cooling nozzles for lower side cooling, the length of the cooling zone can be shortened and the device can be made compact.

In this case, the arrangement of the cooling nozzles on the upper and lower sides of the strip 12 and the density and arrival speed of the coolant are adjusted so that the cooling amount by the coolant on the upper side of the strip (rodlike flows of coolant from the round nozzles 14) is equal to the cooling amount by the coolant on the lower side of the strip (rodlike flows of coolant from the round nozzles 19) and so that the fluid pressure received by the strip from the coolant on the upper side of the strip is equal to the fluid pressure received by the strip from the coolant from the lower side of the strip.

Consequently, in the cooling device 11 of this embodiment, the strip 12 travels over the run out table 5 while being clamped from above and below at the same fluid pressure by the coolant on the upper side of the strip and the coolant on the lower side of the strip, and threading of the strip 12 is stabilized even in a no-tension state until the leading edge of the strip is coiled by a down coiler 6. Moreover, since cooling is performed at the same position on the upper side and the lower side of the strip 12, a heat history, in particular, a heat history near the surface layer is substantially equal, and the product quality is equal between the upper and lower sides.

In the cooling device 11 of this embodiment, purging is also performed by an air jet nozzle 22 provided downstream from each cooling unit 17 so that coolant on the upper side of the strip does not flow out.

When the cooling device 11 having the above-described configuration is used, cooling is controlled as follows.

First, the length of a cooling zone where ejection is performed is found from the speed of the strip, measured temperature, and the amount of cooling to the cooling stop temperature for the target thickness. Then, the number of cooling units 17 that cover the found cooling zone length, the number of rows of cooling nozzle headers 13 that perform ejection in the cooling units 17, and the number of rows of lower side cooling nozzle headers 18 are determined, and the corresponding ejection valves 16 and 21 are opened. In this case, the cooling amount by coolant on the upper side of the strip is set to be equal to the cooling amount by coolant on the lower side of the strip, and the fluid pressure received by the strip from the coolant on the upper side of the strip is set to be equal to the fluid pressure received by the strip from the coolant from the lower side of the strip. Subsequently, the number of cooling units 17 and the number of rows of cooling nozzle headers 13 and 18 that perform ejection are adjusted so as to change the cooling zone length while checking the record of a thermometer after cooling and considering the change of the strip speed (acceleration, deceleration). When changing the number of rows of cooling nozzle headers 13, in order to minimize outflow of the coolant into non-cooling zones (air cooling zones) on the strip, it is preferable to adjust the number of rows for ejection from the upstream side to the downstream side and the rows for ejection from the downstream side to the upstream side so that the fluid pressure of the coolant is balanced between the upstream and downstream sides of the strip. For example, it is preferable that upstream and downstream cooling nozzle headers be turned on and off in pairs.

The above-described embodiment can obtain the following advantages:

(1) The strip can be uniformly cooled from the leading edge to the trailing edge, and the quality of the strip is stabilized. This reduces the cutting allowance of the strip and increases the yield.

(2) Since the strip travels over the run out table while being clamped by upper and lower rodlike flows, threading of the strip is stabilized even in a no-tension state until the leading edge of the strip is coiled. Consequently, trouble, such as a strip jam and a shutdown, is reduced.

(3) Since cooling histories on the upper and lower sides of the strip are substantially equal, the quality of the strip is uniform on the upper and lower sides.

Figure 9:
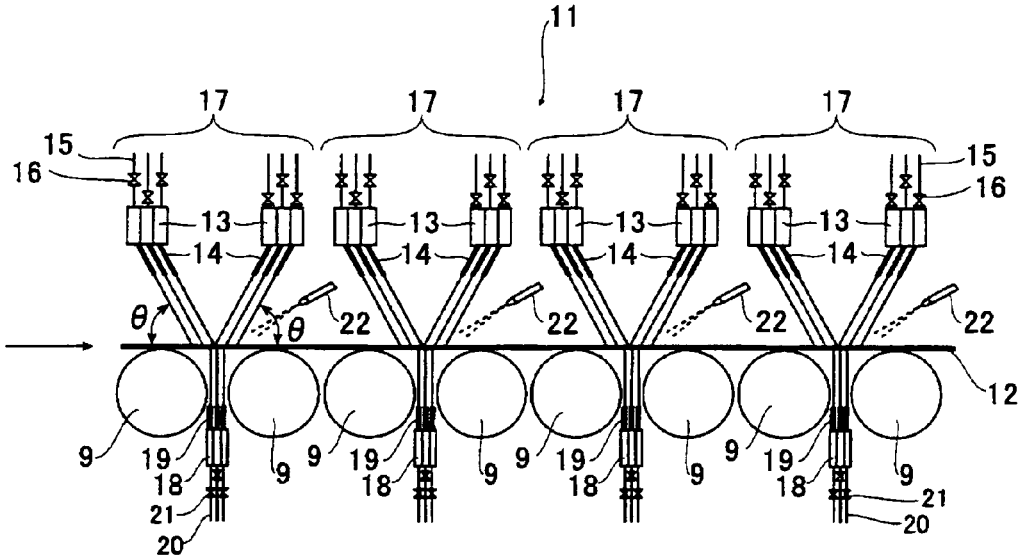
FIG. 9 is an explanatory view of a cooling device according to a further embodiment of the present invention.
Figure 10:
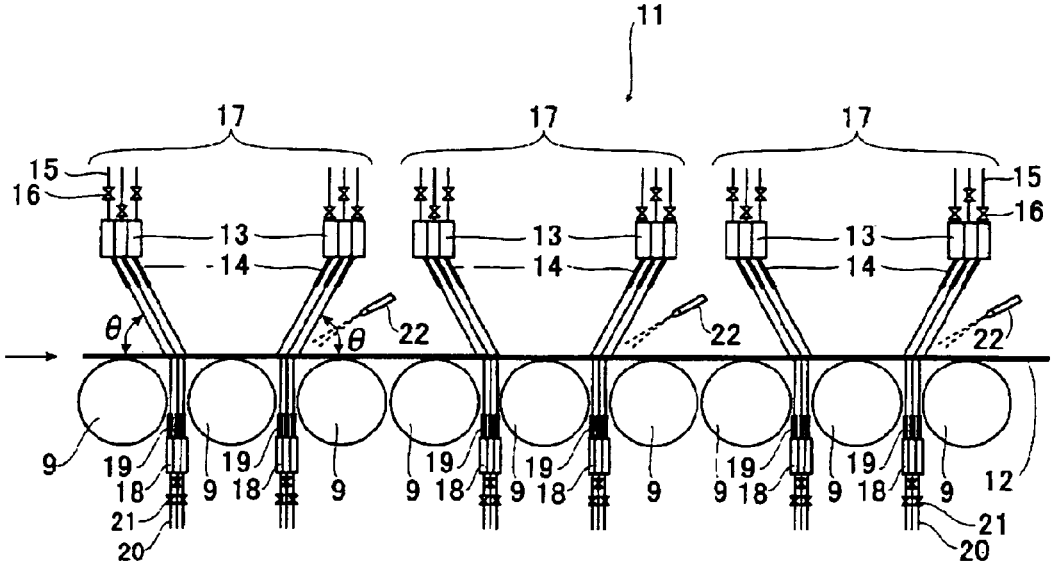
FIG. 10 is an explanatory view of a cooling device according to a further embodiment of the present invention.
Figure 11A:
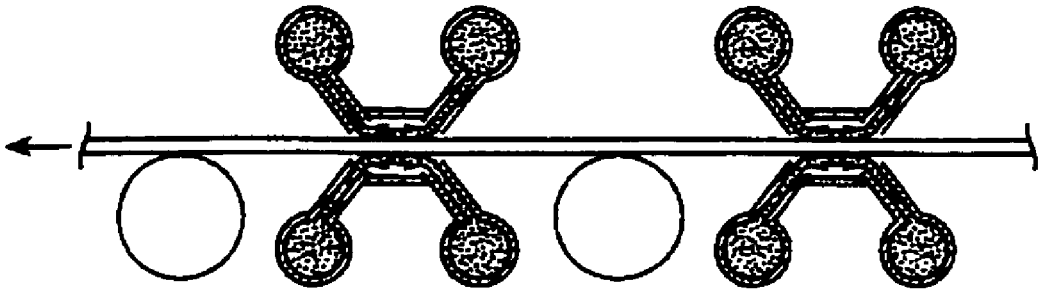
FIGS. 11A and 11B are explanatory view of the related art.
Figure 11B:
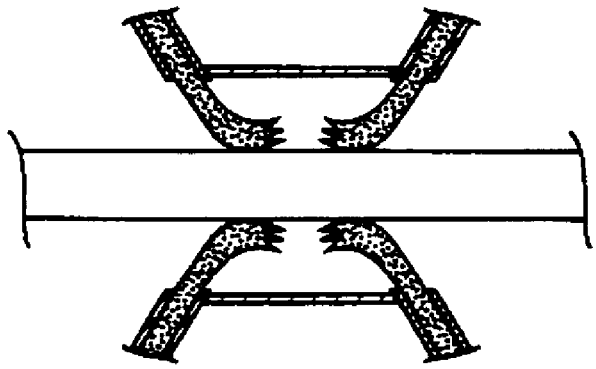

In this embodiment, toward just above the same position as the position where rodlike flows of coolant ejected from the lower cooling nozzles collide with the strip, inclined rodlike flows of coolant are ejected from the upstream and downstream sides of the position on the upper side of the strip so as to oppose each other, as shown in FIG. 9. The present invention is not limited thereto. For example, as shown in FIG. 10, inclined rodlike flows of coolant ejected toward just above a position, where lower rodlike flows of coolant collide with the strip, from the upstream side of the position, and inclined rodlike flows of coolant ejected toward just above a position, where lower rodlike flows of coolant downstream from the above rodlike flows collide with the strip, from the downstream side of the position may oppose each other. However, it is preferable to eject opposing rodlike flows toward just above the same position where rodlike flows ejected from the lower cooling nozzles collide with the strip in order for the coolant ejected onto the upper side of the strip to quickly flow out from both edges of the strip and in order to stabilize threading.

While the known type of cooling device 7 and the cooling device 11 of the present invention are arranged in that order as the cooling device provided on the run out table 5 for upper side cooling in the two embodiments described above as the further embodiments, it is satisfactory as long as the cooling device 11 of the present invention forms a part or the entirety of the cooling device provided on the run out table 5. Although cooling is brought into an unstable state called transition boiling near the down coiler, depending on the coiling temperature, as described above, the cooling device 11 of the present invention provides nucleic boiling over the entire surface, and avoids a transition boiling region where cooling is unstable. Since stable cooling can be performed, regardless of the coiling temperature, and the coiling temperature can be controlled precisely, it is preferable that the cooling device 11 of the present invention be provided at least just before the down coiler. With this arrangement, unstable cooling is avoided and temperature variations are small even at a low coiling temperature (500° C. or less). As a result, the quality of the strip, such as strength and elongation, is uniform over the overall length of the strip.

EXAMPLES

First Example

As a first example, a strip having a finish thickness of 2.8 mm was manufactured with the cooling nozzle header device shown in FIG. 2 in the equipment arrangement shown in FIG. 1 on the basis of the above-described first embodiment. In the cooling device 11 of the present invention, six cooling units were mounted, and each cooling unit included four rows of cooling nozzle headers on the upstream side and four rows of cooling nozzle headers on the downstream side. The speed of the leading edge of the strip was 700 mpm on the exit side of the finishing stand 4, and the strip speed was sequentially increased to a maximum of 1000 mpm after the leading edge of the strip reached the down coiler 6. The temperature of the strip on the exit side of the finishing stand was 850° C. The strip was cooled to about 600° C. by the known type of cooling device 10, and was then cooled to 400° C., which was a target coiling temperature, by the cooling device 11 of the present invention. Herein, the ejection angle θ of coolant from the cooling device 11 was set at 50°, and the ejection speed of coolant was set at 30 m/s so that the flow rate of the coolant in the longitudinal direction of the strip when the coolant collided with the strip was more than or equal to the maximum speed of the strip. Consequently, the flow rate in the longitudinal direction of the strip is 30 m/s×cos 50°≈1152 mpm.

Cooling was controlled as follows. The length of a cooling zone on the upper and lower sides where coolant is ejected is found from the speed of the strip, measured temperature, and cooling amount to the cooling stop temperature for the target thickness. An upper side cooling condition and a lower side cooling condition that cover the found cooling zone length are found, a portion for lower side cooling is excluded, and the number of cooling units 17 and the number of rows of cooling nozzle headers 13 that perform ejection in the cooling unit 17 are determined for upper side cooling, and the corresponding ejection valves 16 are opened. Subsequently, the number of cooling units and the number of rows of cooling nozzle headers that perform ejection were adjusted so as to change the cooling zone length while checking the record of the thermometer after cooling and considering the change of the strip speed (acceleration, deceleration). When changing the number of rows of cooling nozzle headers that perform ejection, the number of rows for ejection from the upstream side to the downstream side and the number of rows for ejection from the downstream side to the upstream side were adjusted so that the fluid pressure of coolant was balanced between the upstream and downstream sides of the strip, and upstream and downstream cooling nozzle headers were turned on and off in pairs.

Further, the zone length in each cooling unit 17 was adjusted so that martensite would not be formed in the upper surface of the strip on the exit side of the cooling unit 17, the air cooling zone length was determined so that sufficient heat recovery would be completed by diffusion of internal heat in the next air cooling zone, and the use conditions of subsequent cooling units 17 were determined. Incidentally, since a martensite structure is formed in the steel used herein at a temperature of 350° C. or less, cooling was controlled so that the surface would not decrease to 350° C. or less.

As a result, in this example, the temperature of the strip at the down coiler 6 was within the range of 400° C.±10° C. over the entire length, and considerably uniform cooling was realized. Moreover, a tempered martensite structure did not exist on the upper surface layer of the strip. Consequently, a strip that was stable in quality could be obtained.

Second Example

As a second example, a strip having a finish thickness of 2.4 mm was manufactured with the cooling nozzle header device shown in FIG. 3 in the equipment arrangement shown in FIG.

1 on the basis of the above-described first embodiment. In the cooling device 11 of the present invention, three cooling units were mounted, and each cooling unit included eight rows of cooling nozzle headers on the upstream side and eight rows of cooling nozzle headers on the downstream side. The speed of the leading edge of the strip was 750 mpm on the exit side of the finishing stand 4, and the strip speed was sequentially increased to a maximum of 1000 mpm after the leading edge of the strip reached the down coiler 6. The temperature of the strip on the exit side of the finishing stand was 860° C. The strip was cooled to about 650° C. by the known type of cooling device 10, and was then cooled to 450° C., which was a target coiling temperature, by the cooling device 11 of the present invention. Herein, the ejection angle θ of coolant from the cooling device 11 was set at 45°, and the ejection speed of coolant was set at 35 m/s so that the flow rate of the coolant in the longitudinal direction of the strip when the coolant collided with the strip was more than or equal to the maximum speed of the strip. Consequently, the flow rate in the longitudinal direction of the strip is 30 m/s×cos 45°≈1484 mpm.

Similarly to the above-described first example, cooling was controlled, that is, the number of cooling units and the number of rows of cooling nozzle headers that perform ejection were adjusted so as to change the cooling zone length.

In order to alternately repeat water cooling and air cooling (intermittent cooling) so that martensite would not be formed in the upper surface of the strip on the exit side of each cooling unit 17, the cooling zone length in the cooling unit 17 was adjusted by changing the number of rows of cooling nozzle headers that perform ejection in the cooling unit 17, and the use condition of the cooling unit was determined. Incidentally, since a martensite structure is formed in the steel used herein at a temperature of 350° C. or less, cooling was controlled so that the surface temperature would not decrease to 350° C. or less.

As a result, in the second example, the temperature of the strip at the down coiler 6 was within the range of 450° C.±8° C. over the entire length, and considerably uniform cooling was realized. Moreover, a tempered martensite structure did not exist in the upper surface layer of the strip. Consequently, a strip that was stable in quality could be obtained.

Third Example

As a third example, a strip having a finish thickness of 3.6 mm was manufactured with the cooling nozzle header device shown in FIG. 4 in the equipment arrangement shown in FIG. 5 on the basis of the above-described second embodiment. In the cooling device 11 of the present invention, five cooling units were mounted, and each cooling unit included sixteen rows of cooling nozzle headers on the upstream side and sixteen rows of cooling nozzle headers on the downstream side. The speed of the leading edge of the strip was 600 mpm on the exit side of the finishing stand 4, and the strip speed was sequentially increased to a maximum of 800 mpm after the leading edge of the strip reached the down coiler 6. The temperature of the strip on the exit side of the finishing stand was 840° C. The strip was cooled to about 650° C. by the cooling device 11 of the present invention, and was then cooled to 500° C., which was a target coiling temperature, by the known type of cooling device 7. Herein, the ejection angle θ of coolant from the cooling device 11 was set at 55°, and the ejection speed of coolant was set at 30 m/s so that the flow rate of the coolant in the longitudinal direction of the strip when the coolant collided with the strip was more than or equal to the maximum speed of the strip. Consequently, the flow rate in the longitudinal direction of the strip is 30 m/s×cos 55°≈1032 mpm.

Similarly to the above-described first example, cooling was controlled, that is, the number of cooling units and the number of rows of cooling nozzle headers that perform ejection were adjusted so as to change the cooling zone length.

Incidentally, in order to form bainite over the entire thickness of the steel used herein, a high cooling speed is necessary during cooling from 800° C. to 600° C. However, since a martensite structure is formed at a temperature of 350° C. or less, cooling was controlled so that the surface temperature would not decrease to 350° C. or less. In other words, the cooling speed was increased, and the distance between the air cooling zone and the water cooling zone was adjusted so that the surface temperature would not decrease to 350° C. or less.

As a result, in the third example, the temperature of the strip at the down coiler 6 was within the range of 500° C.±12° C. over the entire length, and considerably uniform cooling was realized. Moreover, since the cooling speed was high and stable, a uniform bainite structure could be formed in the thickness direction of the strip, and a high-strength material could be manufactured.

Fourth Example

As a fourth example, a strip having a finish thickness of 4.0 mm was manufactured in the equipment arrangement shown in FIG. 6 on the basis of the above-described third embodiment by using the cooling nozzle header device shown in FIG. 4 on the upstream side of the run out table and using the cooling nozzle header device shown in FIG. 2 on the downstream side of the run out table. In the upstream cooling device 11 of the present invention, five cooling units were mounted, and each cooling unit included sixteen rows of cooling nozzle headers on the upstream side and sixteen rows of cooling nozzle headers on the downstream side. In the downstream cooling device 11 of the present invention, three cooling units were mounted, and each cooling unit included four rows of cooling nozzle headers on the upstream side and four rows of cooling nozzle headers on the downstream side. The speed of the leading edge of the strip was 500 mpm on the exit side of the finishing stand 4, and the strip speed was sequentially increased to a maximum of 550 mpm after the leading edge of the strip reached the down coiler 6. The temperature of the strip on the exit side of the finishing stand was 850° C. The strip was cooled to about 650° C. by the upstream cooling device 11 of the present invention, and was then cooled to 400° C., which was a target coiling temperature, by the upstream cooling device 11 of the present invention without using the known type of cooling device 7. Herein, the ejection angle θ of coolant from the upstream and downstream cooling devices 11 was set at 45°, and the ejection speed of coolant was set at 30 m/s so that the flow rate of the coolant in the longitudinal direction of the strip when the coolant collided with the strip was more than or equal to the maximum speed of the strip. Consequently, the flow rate in the longitudinal direction of the strip is 30 m/s×cos 45°≈1272 mpm.

Similarly to the above-described first example, cooling was controlled, that is, the number of cooling units and the number of rows of cooling nozzle headers that perform ejection were adjusted so as to change the cooling zone length.

Incidentally, in order to form bainite over the entire thickness of the steel used herein, a high cooling speed is necessary during cooling from 800° C. to 600° C. However, since a martensite structure is formed at a temperature of 350° C. or less, cooling was controlled so that the surface temperature would not decrease to 350° C. or less. In other words, the cooling speed was increased, and the distance between the air cooling zone and the water cooling zone in each of the upstream and downstream cooling devices 11 was adjusted so that the surface temperature would not decrease to 350° C. or less.

As a result, in this example, the temperature of the strip at the down coiler 6 was within the range of 400° C.±11° C. over the entire length, and considerably uniform cooling was realized. Moreover, since the cooling speed was high and stable, a uniform bainite structure could be formed in the thickness direction of the strip, and a high-strength material could be manufactured.

Fifth Example

As a fifth example, a strip having a finish thickness of 2.8 mm was manufactured by using the equipment shown in FIGS. 1 and 7 on the basis of the above-described embodiment. The speed of the leading edge of the strip was 700 mpm on the exit side of the finishing stand 4, and the strip speed was sequentially increased to a maximum of 1000 mpm after the leading edge of the strip reached the down coiler 6. The temperature of the strip on the exit side of the finishing stand was 850° C. The strip was cooled to about 650° C. by the known type of cooling device 10, and was then cooled to 400° C., which was a target coiling temperature, by the cooling device 11 of the present invention. Herein, the ejection angle θ of coolant from the cooling device 11 was set at 50°, and the ejection speed of coolant was set at 30 m/s so that the flow rate of the coolant in the longitudinal direction of the strip when the coolant collided with the strip was more than or equal to the maximum speed of the strip. Consequently, the flow rate in the longitudinal direction of the strip is 30 m/s×cos 50°≈1152 mpm.

Cooling was controlled as follows. First, the lengths of cooling zones on the upper and lower sides where coolant was ejected were found from the speed of the strip, measured temperature, and cooling amount to the cooling stop temperature for the target thickness. Then, the number of cooling units 17 that cover the found cooling zone length on the upper side and the number of rows of cooling nozzle headers 13 that perform ejection in the cooling units 17 were determined, and the corresponding ejection valves 16 are opened. Moreover, the number of cooling nozzle headers 18 that cover the found cooling zone length on the lower side was determined, and the corresponding ejection valves 21 were opened. In this case, the cooling amount by coolant on the upper side of the strip was set to be equal to the cooling amount by coolant on the lower side of the strip. Subsequently, the number of cooling units 17 on the upper side, the number of rows of cooling nozzle headers 13 that perform ejection, and the number of cooling nozzle headers 18 that perform ejection on the lower side were adjusted so as to change the cooling zone lengths while checking the record of the thermometer after cooling and considering the change of the strip speed (acceleration, deceleration). When changing the number of rows of cooling nozzle headers that perform ejection, the number of rows for ejection from the upstream side to the downstream side and the number of rows for ejection from the downstream side to the upstream side were adjusted so that the fluid pressure of coolant was balanced between the upstream and downstream sides of the strip, and the upstream and downstream cooling nozzle headers were turned on and off in pairs.

Further, the zone length in each cooling unit 17 was adjusted so that martensite would be formed in the upper surface of the strip on the exit side of the cooling unit 17, the air cooling zone length was determined so that sufficient heat recovery would be completed by diffusion of internal heat in the next air cooling zone, and the use conditions in subsequent cooling units 17 were determined. Incidentally, since a martensite structure is formed in the steel used herein at a temperature of 350° C. or less, cooling was controlled so that the surface temperature would not decrease to 350° C. or less.

As a result, in this example, the temperature of the strip at the down coiler 6 was within the range of 400° C.±10° C. over the entire length, and considerably uniform cooling was realized. Moreover, a tempered martensite structure did not exist in the upper surface layer of the strip. Consequently, a strip that was stable in quality could be obtained.

Sixth Example

As a sixth example, a strip having a finish thickness of 2.8 mm was manufactured by using the equipment shown in FIGS. 1 and 9 on the basis of the above-described embodiment. The speed of the leading edge of the strip was 700 mpm on the exit side of the finishing stand 4, and the strip speed was sequentially increased to a maximum of 1000 mpm after the leading edge of the strip reached the down coiler 6. The temperature of the strip on the exit side of the finishing stand was 850° C. The strip was cooled to about 650° C. by the known type of cooling device 10, and was then cooled to 400° C., which was a target coiling temperature, by the cooling device 11 of the present invention. Herein, the ejection angle θ of coolant from the cooling device 11 was set at 50°, and the ejection speed of coolant was set at 30 m/s so that the flow rate of the coolant in the longitudinal direction of the strip when the coolant collided with the strip was more than or equal to the maximum speed of the strip. Consequently, the flow rate in the longitudinal direction of the strip is 30 m/s×cos 50°≈1152 mpm.

Cooling was controlled as follows. First, the length of a cooling zone where coolant was ejected was found from the speed of the strip, measured temperature, and cooling amount to the cooling stop temperature for the target thickness. An upper side cooling condition and a lower side cooling condition that cover the found cooling zone length were found, the number of cooling units 17 and the number of rows of upper and lower cooling nozzle headers 13 and 18 that perform ejection in the cooling units 17 were determined, and the corresponding ejection valves were opened. In this case, the cooling amount by coolant on the upper side of the strip was set to be equal to the cooling amount by coolant on the lower side of the strip, and the fluid pressure received by the strip from the coolant on the upper side of the strip was set to be equal to the fluid pressure received by the strip from the coolant on the lower side of the strip. Subsequently, the number of cooling units and the number of cooling nozzle headers 13 and 18 that perform ejection were adjusted so as to change the cooling zone length while checking the record of the thermometer after cooling and considering the change of the strip speed (acceleration, deceleration). When changing the number of rows of cooling nozzle headers 13, the number of rows for ejection from the upstream side to the downstream side and the number of rows for ejection from the downstream side to the upstream side were adjusted so that the fluid pressure of coolant was balanced between the upstream and downstream sides of the strip, and the upstream and downstream cooling nozzle headers were turned on and off in pairs.

Further, the zone length in each cooling unit 17 was adjusted so that martensite would not be formed in the upper surface of the strip on the exit side of the cooling unit 17, the air cooling zone length was determined so that sufficient heat recovery would be completed by diffusion of internal heat in the next air cooling zone, and the use conditions in subsequent cooling units 17 were determined. Incidentally, since a martensite structure is formed in the steel used herein at a temperature of 350° C. or less, cooling was controlled so that the surface temperature would not decrease to 350° C. or less.

As a result, in this example, the temperature of the strip at the down coiler 6 was within the range of 400° C.±10° C. over the entire length, and considerably uniform cooling was realized. Moreover, a tempered martensite structure did not exist in the upper surface layer of the strip. Consequently, a strip that was stable in quality could be obtained.

First Comparative Example

For comparison with the advantages of the present invention provided in coiling at a low temperature less than 500° C. in the above-described first, second, and fourth examples, as a first comparative example, cooling to 400° C., which was a target coiling temperature, was performed only with the known type of cooling device 7 (round type laminar flow nozzles 8 on the upper side and spray nozzles 10 on the lower side) without using the cooling device 11 of the present invention in the same equipment as those adopted in the examples. Other structures were similar to those in the examples.

As a result, in the comparative example, since laminar flows from the round type laminar flow nozzles 8 were free fall flows, they did not easily reach the strip 12 when there was residual coolant. Moreover, the cooling ability differed depending on the presence or absence of the residual coolant, and hunting of the temperature was found in the longitudinal direction of the strip. In particular, the coolant stayed in a concave portion at the leading edge of the strip from when coiling by the down coiler 6 was started until when the strip was tensioned, and the temperature thereby varied in the longitudinal direction of the strip. Therefore, the temperature in the strip greatly varied within the range of 250° C. to 450° C. in contrast to the target temperature of 400° C. at the down coiler 6. For this reason, the strength greatly varied in the strip.

Second Comparative Example

For comparison with the advantages of rapid cooling by the cooling device 11 of the present invention immediately after finish rolling in the above-described third and fourth examples, as a second comparative example, cooling to 500° C., which was a target coiling temperature, was performed only with the known type of cooling device 7 (round type laminar flow nozzles 8 on the upper side and spray nozzles 10 on the lower side) without using the cooling device 11 of the present invention in the same equipment as that adopted in the first example. Other structures were similar to those adopted in the third example.

As a result, in the second comparative example, since laminar flows from the round type laminar flow nozzles 8 were free fall flows, they did not easily reach the strip 12 when there was residual coolant. Moreover, the cooling ability differed, depending on the presence or absence of the residual coolant, and hunting of the temperature was found in the longitudinal direction of the strip. In particular, the coolant stayed in a concave portion at the leading edge of the strip from when coiling by the down coiler 6 was started until when the strip was tensioned, and the temperature thereby varied in the longitudinal direction of the strip. Therefore, the temperature in the strip greatly varied within the range of 400° C. to 500° C. in contrast to the target temperature of 500° C. at the down coiler 6. For this reason, the strength greatly varied in the strip. Further, since the cooling speed was lower than in the third and fourth examples, a soft layer, such as ferrite or pearlite, was locally formed, and the target strength could not be obtained.

The invention claimed is:

1. A hot-strip cooling device for cooling a hot strip conveyed on a run out table after finish rolling, the cooling device comprising:

an upstream section provided at an upper side of the strip and comprising a plurality of rows of first cooling nozzles that eject rodlike flows of coolant, wherein each row extends in a width direction of the strip, and the plurality of rows are arranged along a traveling direction of the strip; and a downstream section provided at the upper side of the strip downstream of the upstream section in the traveling direction of the strip and comprising a plurality of rows of second cooling nozzles that eject rodlike flows of coolant, wherein each row extends in the width direction of the strip, and the plurality of rows are arranged along the traveling direction of the strip;

wherein the first cooling nozzles are inclined towards a downstream side in the traveling direction of the strip, and are inclined to eject the rodlike flows of coolant to an upper surface of the strip such that the rodlike flows are at an angle of 45-60° with respect to the upper surface of the strip;

wherein the second cooling nozzles are inclined towards an upstream side in the traveling direction of the strip, and are inclined to eject the rodlike flows of coolant to the upper surface of the strip such that the rodlike flows are at an angle of 45-60° with respect to the upper surface of the strip;

wherein the upstream section and the downstream section are opposed to each other;

wherein the upstream section is arranged upstream of a strip-conveying roller table, and the first cooling nozzles are inclined such that the rodlike flows are ejected from positions upstream of the roller table to positions vertically just above the roller table; and wherein the downstream section is arranged downstream of a strip-conveying roller table, and the second cooling nozzles are inclined such that the rodlike flows are ejected from positions downstream of the roller table to positions vertically just above the roller table.

2. The hot-strip cooling device according to claim 1, wherein the first cooling nozzles are inclined to eject the rodlike flows of coolant to the upper surface of the strip such that the rodlike flows are at an angle of 45-50° with respect to the upper surface of the strip; and wherein the second cooling nozzles are inclined to eject the rodlike flows of coolant to the upper surface of the strip such that the rodlike flows are at an angle of 45-50° with respect to the upper surface of the strip.

3. The hot-strip cooling device according to claim 1, wherein the first cooling nozzles and the second cooling nozzles eject the rodlike flows to positions vertically just above the same roller table.

4. The hot-strip cooling device according to claim 1, wherein the first cooling nozzles and the second cooling nozzles eject the rodlike flows to positions vertically just above different roller tables.

5. The hot-strip cooling device according to claim 1, further comprising a plurality of third cooling nozzles arranged between adjacent roller tables at a lower side of the strip to eject coolant to a lower surface of the strip.

6. The hot-strip cooling device according to claim 5, wherein the first, second, and third cooling nozzles are arranged so that a cooling amount by the coolant on the upper surface of the strip is equal to a cooling amount by the coolant on the lower surface of the strip.

7. The hot-strip cooling device according to claim 6, wherein the third cooling nozzles eject rodlike flows of coolant.

8. A hot-strip cooling device for cooling a hot strip conveyed on a run out table after finish rolling, the cooling device comprising:

an upstream section provided at an upper side of the strip and comprising a plurality of rows of first cooling nozzles that eject rodlike flows of coolant, wherein each row extends in a width direction of the strip, and the plurality of rows are arranged along a traveling direction of the strip;

a downstream section provided at the upper side of the strip downstream of the upstream section in the traveling direction of the strip and comprising a plurality of rows of second cooling nozzles that eject rodlike flows of coolant, wherein each row extends in the width direction of the strip, and the plurality of rows are arranged along the traveling direction of the strip; and a plurality of third cooling nozzles provided at a lower side of the strip, between adjacent strip-conveying roller tables;

wherein the first cooling nozzles are inclined towards a downstream side in the traveling direction of the strip, and are inclined to eject the rodlike flows of coolant to an upper surface of the strip such that the rodlike flows are at an angle of 45-60° with respect to the upper surface of the strip;

wherein the second cooling nozzles are inclined towards an upstream side in the traveling direction of the strip, and are inclined to eject the rodlike flows of coolant to the upper surface of the strip such that the rodlike flows are at an angle of 45-60° with respect to the upper surface of the strip;

wherein the upstream section and the downstream section are opposed to each other;

wherein the first cooling nozzles are inclined such that the rodlike flows are ejected in a downstream direction to positions of the upper surface of the strip in an area between adjacent roller tables where coolant is ejected by the third cooling nozzles to a lower surface of the strip;

wherein the second cooling nozzles are inclined such that the rodlike flows are ejected in an upstream direction to positions of the upper surface of the strip in an area between adjacent roller tables where coolant is ejected by the third cooling nozzles to the lower surface of the strip; and wherein the first, second, and third cooling nozzles are arranged such that a cooling amount by the coolant on the upper surface of the strip is equal to a cooling amount by the coolant on the lower surface of the strip, and such that a fluid pressure received by the strip from the coolant on the upper surface of the strip is equal to a fluid pressure received by the strip from the coolant on the lower surface of the strip.

9. The hot-strip cooling device according to claim 8, wherein the first cooling nozzles are inclined to eject the rodlike flows of coolant to the upper surface of the strip such that the rodlike flows are at an angle of 45-50° with respect to the upper surface of the strip; and wherein the second cooling nozzles are inclined to eject the rodlike flows of coolant to the upper surface of the strip such that the rodlike flows are at an angle of 45-50° with respect to the upper surface of the strip.

10. The hot-strip cooling device according to claim 8, wherein the first cooling nozzles and the second cooling nozzles eject the rodlike flows to the same area between a same pair of adjacent roller tables.

11. The hot-strip cooling device according to claim 8, wherein the first cooling nozzles and the second cooling nozzles eject the rodlike flows to different areas between different pairs of adjacent roller tables.

12. The hot-strip cooling device according to claim 8, wherein the third cooling nozzles eject rodlike flows of coolant.

13. A hot-strip cooling device for cooling a hot strip conveyed on a run out table after finish rolling, the cooling device comprising:

an upstream section provided at an upper side of the strip and comprising a plurality of rows of first cooling nozzles that eject rodlike flows of coolant, wherein each row extends in a width direction of the strip, and the plurality of rows are arranged along a traveling direction of the strip;

a downstream section provided at the upper side of the strip downstream of the upstream section in the traveling direction of the strip and comprising a plurality of rows of second cooling nozzles that eject rodlike flows of coolant, wherein each row extends in the width direction of the strip, and the plurality of rows are arranged along the traveling direction of the strip; and a plurality of third cooling nozzles provided at a lower side of the strip, between adjacent strip-conveying roller tables;

wherein the first cooling nozzles are inclined towards a downstream side in the traveling direction of the strip, and are inclined to eject the rodlike flows of coolant to an upper surface of the strip such that the rodlike flows are at an angle of 45-60° with respect to the upper surface of the strip;

wherein the second cooling nozzles are inclined towards an upstream side in the traveling direction of the strip, and are inclined to eject the rodlike flows of coolant to the upper surface of the strip such that the rodlike flows are at an angle of 45-60° with respect to the upper surface of the strip;

wherein the upstream section and the downstream section are opposed to each other;

wherein the first cooling nozzles are inclined such that the rodlike flows are ejected in a downstream direction to (i) positions vertically just above one of the roller tables and (ii) positions of the upper surface of the strip in an area between adjacent roller tables where coolant is ejected by the third cooling nozzles to a lower surface of the strip;

wherein the second cooling nozzles are inclined such that the rodlike flows are ejected in an upstream direction to (i) positions vertically just above another one of the roller tables and (ii) positions of the upper surface of the strip in an area between adjacent roller tables where coolant is ejected by the third cooling nozzles to a lower surface of the strip; and wherein the first, second, and third cooling nozzles are arranged such that a cooling amount by the coolant on the upper surface of the strip is equal to a cooling amount by the coolant on the lower surface of the strip, and such that a fluid pressure received by the strip from the coolant on the upper surface of the strip is equal to a fluid pressure received by the strip from the coolant on the lower surface of the strip.

14. The hot-strip cooling device according to claim 13, wherein the first cooling nozzles are inclined to eject the rodlike flows of coolant to the upper surface of the strip such that the rodlike flows are at an angle of 45-50° with respect to the upper surface of the strip; and wherein the second cooling nozzles are inclined to eject the rodlike flows of coolant to the upper surface of the strip such that the rodlike flows are at an angle of 45-50° with respect to the upper surface of the strip.

15. A hot-strip cooling method for cooling a hot strip conveyed on a run out table after finish rolling, the method comprising:

ejecting a plurality of rows of first rodlike flows of coolant to an upper surface of the strip, and ejection a plurality of rows of second rodlike flows of coolant to the upper surface of the strip, wherein each row extends in a width direction of the strip, and the plurality of rows are arranged along a traveling direction of the strip;

wherein the first rodlike flows are inclined towards a downstream side in the traveling direction of the strip at an angle of 45-60° with respect to the upper surface of the strip;

wherein the second rodlike flows are inclined towards an upstream side in the traveling direction of the strip at an angle of 45-60° with respect to the upper surface of the strip;

wherein the first rodlike flows and the second rodlike flows are opposed to each other;

wherein the first rodlike flows are inclined such that the rodlike flows are ejected from positions upstream of a strip-conveying roller table to positions vertically just above the roller table; and wherein the second rodlike flows inclined such that the rodlike flows are ejected from positions downstream of a strip-conveying roller table to positions vertically just above the roller table.

16. The hot-strip cooling method according to claim 5, wherein the first rodlike flows are inclined at an angle of 45-50° with respect to the upper surface of the strip; and wherein the second rodlike flows are inclined at an angle of 45-50° with respect to the upper surface of the strip.

17. The hot-strip cooling method according to claim 15, wherein the first rodlike flows and the second rodlike flows are ejected to positions vertically just above the same roller table.

18. The hot-strip cooling method according to claim 15, wherein the first rodlike flows and the second rodlike flows are ejected to positions vertically just above different roller tables.

19. The hot-strip cooling method according to claim 15, further comprising ejecting a plurality of third flows of coolant to a lower surface of the strip.

20. The hot-strip cooling method according to claim 19, wherein the first, second, and third flows of coolant are ejected such that a cooling amount by the coolant on the upper surface of the strip is equal to a cooling amount by the coolant on the lower surface of the strip.

21. The hot-strip cooling method according to claim 20, wherein the third flows of coolant are rodlike flows of coolant.

22. A hot-strip cooling method for cooling a hot strip conveyed on a run out table after finish rolling, the method comprising:

ejecting a plurality of rows of first rodlike flows of coolant to an upper surface of the strip, and ejection a plurality of rows of second rodlike flows of coolant to the upper surface of the strip, wherein each row extends in a width direction of the strip, and the plurality of rows are arranged along a traveling direction of the strip;

ejecting third flows of coolant to a lower surface of the strip between adjacent strip-conveying roller tables;

wherein the first rodlike flows are inclined towards a downstream side in the traveling direction of the strip at an angle of 45-60° with respect to the upper surface of the strip;

wherein the second rodlike flows are inclined towards an upstream side in the traveling direction of the strip at an angle of 45-60° with respect to the upper surface of the strip;

wherein the first rodlike flows and the second rodlike flows are opposed to each other;

wherein the first rodlike flows are inclined such that the rodlike flows are ejected in a downstream direction to positions of the upper surface of the strip in an area between adjacent roller tables where the third flows are ejected to the lower surface of the strip;

wherein the second rodlike flows are inclined such that the rodlike flows are ejected in an upstream direction to positions of the upper surface of the strip in an area between adjacent roller tables where the third flows are ejected to the lower surface of the strip; and wherein the first, second, and third flows of coolant are ejected such that a cooling amount by the coolant on the upper surface of the strip is equal to a cooling amount by the coolant on the lower surface of the strip, and such that a fluid pressure received by the strip from the coolant on the upper surface of the strip is equal to a fluid pressure received by the strip from the coolant on the lower surface of the strip.

23. The hot-strip cooling method according to claim 22, wherein the first rodlike flows are inclined at an angle of 45-50° with respect to the upper surface of the strip; and wherein the second rodlike flows are inclined at an angle of 45-50° with respect to the upper surface of the strip.

24. The hot-strip cooling method according to claim 22, wherein the first rodlike flows and the second rodlike flows are ejected to the same area between a same pair of adjacent roller tables.

25. The hot-strip cooling method according to claim 22, wherein the first rodlike flows and the second rodlike flows are ejected to different areas between different pairs of adjacent roller tables.

26. The hot-strip cooling method according to claim 22, wherein the third flows of coolant are rodlike flows of coolant.

27. A hot-strip cooling method for cooling a hot strip conveyed on a run out table after finish rolling, the method comprising:

ejecting a plurality of rows of first rodlike flows of coolant to an upper surface of the strip, and ejection a plurality of rows of second rodlike flows of coolant to the upper surface of the strip, wherein each row extends in a width direction of the strip, and the plurality of rows are arranged along a traveling direction of the strip;

ejecting third flows of coolant to a lower surface of the strip between adjacent strip-conveying roller tables;

wherein the first rodlike flows are inclined towards a downstream side in the traveling direction of the strip at an angle of 45-60° with respect to the upper surface of the strip;

wherein the second rodlike flows are inclined towards an upstream side in the traveling direction of the strip at an angle of 45-60° with respect to the upper surface of the strip;

wherein the first rodlike flows and the second rodlike flows are opposed to each other;

wherein the first rodlike flows are inclined such that the rodlike flows are ejected in a downstream direction to (i) positions vertically just above one of the roller tables and (ii) positions of the upper surface of the strip in an area between adjacent roller tables where coolant is ejected by the third cooling nozzles to a lower surface of the strip;

wherein the second rodlike flows are inclined such that the rodlike flows are ejected in an upstream direction to (i) positions vertically just above another one of the roller tables and (ii) positions of the upper surface of the strip in an area between adjacent roller tables where coolant is ejected by the third cooling nozzles to a lower surface of the strip; and wherein the first, second, and third flows of coolant are ejected such that a cooling amount by the coolant on the upper surface of the strip is equal to a cooling amount by the coolant on the lower surface of the strip, and such that a fluid pressure received by the strip from the coolant on the upper surface of the strip is equal to a fluid pressure received by the strip from the coolant on the lower surface of the strip.

28. The hot-strip cooling method according to claim 27, wherein the first rodlike flows are inclined at an angle of 45-50° with respect to the upper surface of the strip; and wherein the second rodlike flows are inclined at an angle of 45-50° with respect to the upper surface of the strip.

* * * * *

UNITED STATES PATENT AND TRADEMARK OFFICE

CERTIFICATE OF CORRECTION

PATENT NO. : 8,353,191 B2
APPLICATION NO. : 12/226371
DATED : January 15, 2013
INVENTOR(S) : Satoshi Ueoka et al.

It is certified that error appears in the above-identified patent and that said Letters Patent is hereby corrected as shown below:

In the Claims:

Column 25, Claim 16, Line 1:

change “claim 5” to --claim 15--.

Signed and Sealed this
Eighteenth Day of June, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,353,191 B2
APPLICATION NO. : 12/226371
DATED : January 15, 2013
INVENTOR(S) : Satoshi Ueoka et al.

It is certified that error appears in the above-identified patent and that said Letters Patent is hereby corrected as shown below:

In the Claims:

Column 25, line 42 (Claim 16, Line 1)

change "claim 5" to --claim 15--.

This certificate supersedes the Certificate of Correction issued June 18, 2013.

Signed and Sealed this
Sixteenth Day of July, 2013

Teresa Stanek Rea
*Acting Director of the United States Patent and Trademark Office*